United States Patent [19]

Van Hauwaert

[11] Patent Number: 4,724,785

[45] Date of Patent: Feb. 16, 1988

[54] FRAME SUPPORT FOR CONNECTING TWO FLOAT MEMBERS

[75] Inventor: Marc Van Hauwaert, Berchem-Sainte-Agathe, Belgium

[73] Assignee: Brapal S.A., Vaduz, Liechtenstein

[21] Appl. No.: 843,372

[22] Filed: Mar. 24, 1986

[30] Foreign Application Priority Data

Mar. 27, 1985 [BE] Belgium ..... 0/214720

[51] Int. Cl.[4] ..... B63B 3/08

[52] U.S. Cl. ..... 114/61; 114/66; 440/37; 441/74

[58] Field of Search ..... 114/39.2, 61, 63, 66, 114/354, 143, 152, 162, 144 C; 440/37; 441/74, 135

[56] References Cited

U.S. PATENT DOCUMENTS

| | | | |
|---|---|---|---|
| 3,176,647 | 4/1965 | Grengs et al. | 440/37 |
| 3,437,067 | 4/1969 | Malin | 114/66 X |
| 3,473,502 | 10/1969 | Wittkamp | 114/61 X |
| 3,593,684 | 7/1971 | Cogliano | 114/61 |
| 4,662,297 | 5/1987 | Crowley et al. | 114/61 |
| 4,664,049 | 5/1987 | Mourgue et al. | 114/61 X |

FOREIGN PATENT DOCUMENTS

| | | | |
|---|---|---|---|
| 3130907 | 3/1983 | Fed. Rep. of Germany | 114/61 |
| 1559035 | 3/1969 | France | 114/354 |
| 678605 | 12/1964 | Italy | 114/61 |
| 8400134 | 1/1984 | PCT Int'l Appl. | 114/39.2 |
| 8404077 | 10/1984 | PCT Int'l Appl. | 114/39.2 |

*Primary Examiner*—Joseph F. Peters, Jr.
*Assistant Examiner*—Paul E. Salmon
*Attorney, Agent, or Firm*—Cushman, Darby & Cushman

[57] ABSTRACT

A boat includes two sail surf-board floats, a frame cooperating with each of the floats, a rigid framing comprising at least four fastening lugs to be associated pairwise with each of the frames and so arranged as to retain the frames and thereby the floats substantially in parallel relationship, a seat supported by the framing and so arranged as to receive at least one passenger, a motor driven propeller supported on the framing and so arranged as to drive the boat, and a rudder associated with the framing and so arranged as to steer same.

11 Claims, 9 Drawing Figures

FRAME SUPPORT FOR CONNECTING TWO FLOAT MEMBERS

BACKGROUND AND SUMMARY OF THE INVENTION

This invention relates to a boat.

The invention has for object to provide a boat, mainly a hydroplane-type boat which is light-weight, easy to dismantle and convey, very pleasant to use, and which allows moving in shallow waters as well as in deep waters, or in swamps which are difficult to approach with other boat types. Said boat has the advantage which lowers the manufacturing cost thereof, to use existing floats, said floats being used as such without any adapting and without deterioration danger, in such a way that said floats when they are removed from the boat, may be used again for the original purpose thereof.

For this purpose according to the invention, the boat comprises at least two floats comprised of floats from any sail surf-board, a frame cooperating with each said floats and comprised on the one hand of two rigid elements arranged above and underneath the float, and on the other hand of fastening means so arranged through the keep well and/or the mast well from the float, to link said elements temporarily together, to press same against the float and to fix same relative thereto in such a way as to have the element lengthwise axes and the float lengthwise axis lie substantially in the same vertical plane, an undistortable framing comprising at least four fastening lugs to be associated two by two with each rigid element from said frames lying above the floats and so arranged as to retain said elemetns and thereby the floats substantially in parallel relationship, means supported by the framing and so arranged as to receive at least one passenger, means associated with the framing and so arranged as to drive the boat, and means associated with the framing and so arranged as to steer said boat.

In an advantageous embodiment of the invention, said rigid elements comprising each said frames, are so arranged as to have at least that element lying above the float be so shaped as to follow the shape thereof and extend over at least a substantial length portion of said float to enhance the rigidity thereof, the rigid element from each frame which lies underneath the float being so shaped as to be sunk for the major part, in the keel well and/or the mast well.

In an advantageous embodiment of the invention, that rigid element from each frmae the framing is associated with, has uniformly-distributed holes along the lengthwise direction thereof, in such a way that said corresponding fastening lugs from said framing may be moved and secured to said element to adjust the position of the center of gravity from the unit formed by the framing, the means associated therewith and the passenger, relative to the hydrodynamic buoyancy center.

In a particularly advantageous embodiment of the invention, the framing is tubular and has substantially the shape of a square-base pyramid in the corners of which said fastening lugs lie, the passenger seat being arranged on that pyramid side facng the float front, while said means for driving the boat and means for steering same are arranged and supported on the opposite pyramid side, the driving means being comprised of an engine which is mounted in a cradle which is provided in the framing, and which drives an air-propeller revolving inside a protecting wire housing, and the axis of which lies in the symmetry plane of the vertical framing in parallel relationship with the float lengthwise axis, said means for steering the boat being comprised of an air keel lying in the propeller wind-stream, and the swing shaft axis of which lies substantially in said symmetry plane.

BRIEF DESCRIPTION OF THE DRAWINGS

Other details and features of the invention will stand out from the following description, given by way of non limitative example and with reference to the accompanying drawings, in which.

DETAILED DESCRIPTION OF THE INVENTION

Figure 1:
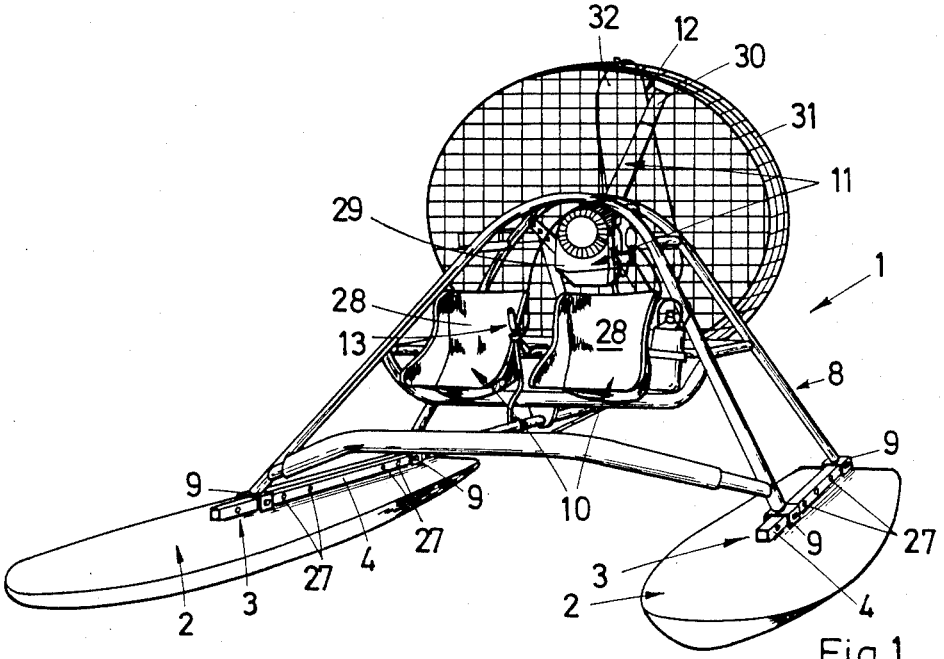
FIG. 1 is a perspective view of a boat according to the invention.

In the various figures, the same reference numerals pertain to identical or similar elements.

According to the invention and as shown in the drawings, the boat 1 comprises two floats comprised of floats 2 from a sail surf-board of any type, a frame 3 cooperating with each said floats 2 and comprised on the one hand of two top and bottom rigid elements 4, 5 enclosing the float, and on the other hand of fastening means 6 so arranged through the float keel well 7 as not to damage said float, to join temporarily elements 4 and 5 together, to press same against the float, and to fix same relative to said float, in such a way as to have the element lengthwise axes and the float lengthwise axis lie substantially in the same vertical plane. The boat further comprises an undistortable framin 8 provided with at least four fastening lugs 9 to be associated two by two with each said rigid elements 4 from the frames 3 and to be so arranged as to retain said elements 4 and thereby said floats 2 substantially in parallel relationship and with a constant spacing, means 10 supported by the framing 8 and so arranged as to receive therein two passengers, means 11 associated with the framing and so arranged as to drive the boat, means 12 associated with said framing and so arranged as to steer said boat, and control means 13 for means 11 and 12 adjacent the means 10.

The top element 4 from each said frames 3 is advantageously so shaped as to follow the shape of the float top. Moreover said element 4 extends over a substantial length portion from said float 2, on either side of the keel well 7, to enhance the float rigidity. The bottom element 5 from each said frames 3 extends over a length which is slightly smaller than the length of said keel well 7, and it is so shaped as to lower the headway resistance as well as the drag of said float, by being sunk for a major part inside said well 7.

Figure 4:
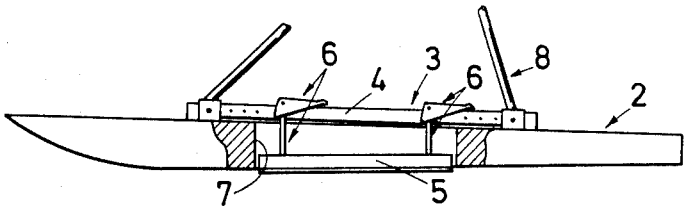
FIG. 4 is a diagrammatic elevation view with parts broken away, of the fastening means for said frames.
Figure 5:
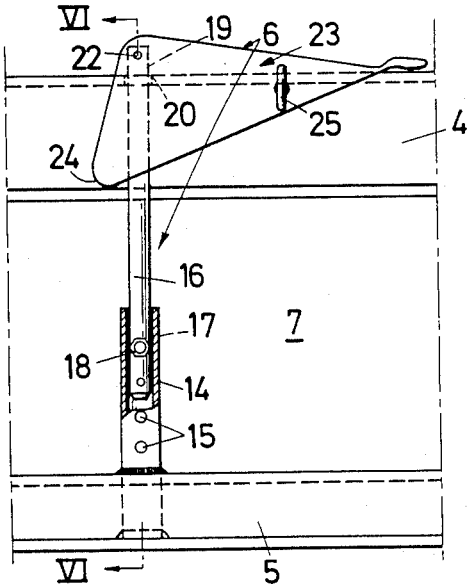
FIG. 5 is a view similar to FIG. 4 on a larger scale than said latter figure, showing details from said fastening means.
Figure 7:
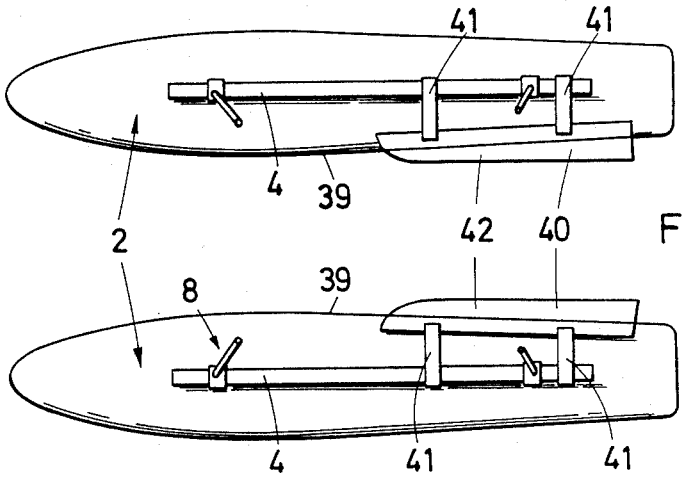
FIG. 7 is a plan view showing a detail from the boat according to the invention.
Figure 6:
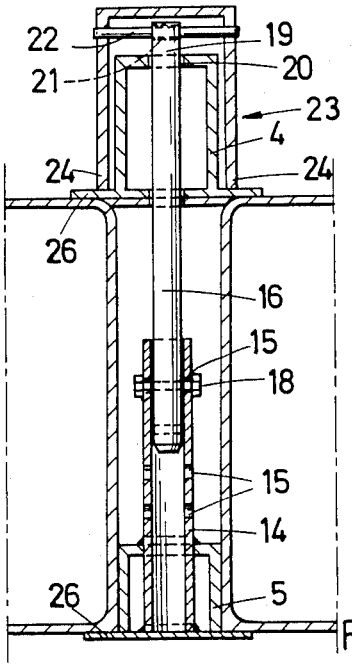
FIG. 6 is a section view along line VI—VI in FIG. 5.
Figure 9:
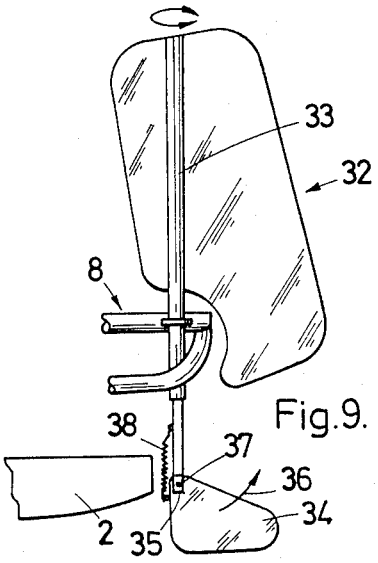
FIG. 9 is an elevation view showing on a larger scale, details from an embodiment of means for steering the boat as showin in FIGS. 1 to 3.

To allow adapting the fastening means 6 of elements 4 and 5 from frames 3 to the various thicknesses of floats 2, said means 6 are adjustable and may possibly in the simplest embodiment thereof, be comprised of a screw-threaded rod the one end of which is secured to element 5, extending through well 7, and the other end of which passes through an opening provided in element 4, and of a clamping nut allowing to clamp the float between said elements 4 and 5. In the embodiment of said fastening means 6 as shown in FIGS. 4 to 6, each said means comprises a sleeve 14 secured at right angle to the bottom float element 5, and which is provided with holes 15 which are uniformly distributed along the axis thereof, a rod 16 co-axial with sleeve 14, so arranged as to be freely moveable therein, and having adjacent the one end thereof, a hole 17 at right angle to the axis thereof, a screw-bolt 18 to be fitted into two corresponding holes 15 from the sleeve and in the hole 17 from the rod to secure same in the selected location relative to the sleeve. The free end 19 of rod 16 passes through an opening 20 provided in the top frame element 4 and has a hole 21 extending at right angle to the rod axis to receive the shaft 22 from a cam lever 23 the cam 24 of which bears on the top element 4 to press thereon along the axis of said rod 16 and in the direction of bottom element 5 to press firmly said elements against float 2.

To prevent an accidental unlocking of fastening means 6, provision is made for locking cam lever 23 on top element 4 with a safety pin 25 passing through the one flange of lever 23 to be received in element 4. Said elements 4 and 5 are tubular in shape and have advantageously a bearing foot 26 which distributes the stresses over the float and more particularly around the keel well 7.

The top element 4 of each frame 3 the framing 8 is associated with, is advantageously provided with holes 27 regularly distributed along the length direction, in such a way that the corresponding fastening lugs 9 of said framing may be displaced and secured to said element 4 to adjust the position of the center of gravity from that unit formed by the framing, the means associated therewith, and the passenger relative to the hydrodynamic buouyancy center.

For reasons of lightness and rigidity, the framing 8 is advantageously tubular in shape and has substantially the shape of a square-base pyramid in the corners of which lie the fastening lugs 9. The seats 28 for both passengers are arranged on that pyramid surface facing to the front of said floats 2, while the means 11 for driving the boat and the means 14 for guiding said boat, are arranged and supported on the opposite surface of said pyramid. The driving means 11 are comprised in the embodiments as shown in the drawings, of an engine 29 which is mounted in a cradle provided in the framing 8 and driving an air-propeller 30 revolving inside a protecting wire housing 31, and the axis of which lies in the framing symmetry plane, vertically and in parallel relationship with the float lengthwise axis, the means 13 for steering the boat being comprised of an air-keel 32 lying in the wind stream of said propeller 30 and the swing shaft axis 33 of which substantially lies in said symmetry plane.

To let the boat turn more closely at low speed, the swing shaft 33 for the air-keel 32 is so extended as to run up to the top level of the floats 2, a back-piece 34 lying substantially in the same plane as the air-keel 32, being hinged to the end 35 of said shaft to be swingable as shown by arrow 36, about a substantailly horizontal shaft 37 against a spring 38, to sink more or less deeply in the water according to the depth thereof. Control means not shown, are advantageously provided adjacent said means 13, to adjust the back-piece position and to fix same temporarily in the selected position.

To avoid the boat drifting and particularly with close turns, each said floats 2 comprises along that edge 39 thereof facing the other float, a keel 40 extending from the float back over a length at least equal to one third the float length. Said keel 40 is secured to the frame 3 with rods 41 following the float outline, and has a flexible part 42 which can follow said outline and extends below the float bottom level.

Figure 8:
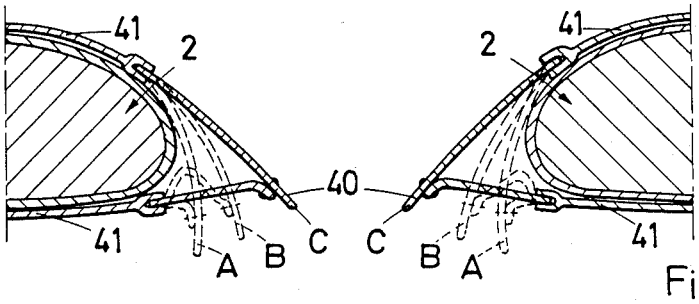
FIG. 8 is a section view along line VIII—VIII in FIG. 7.

As shown in FIG. 8, said flexible part 42 may take various positions and notably a position A corresponding to a close turn, a position B corresponding to a straight-line sailing at low speed, and a position C corresponding to a straight-line sailing at high speed.

Figure 2:
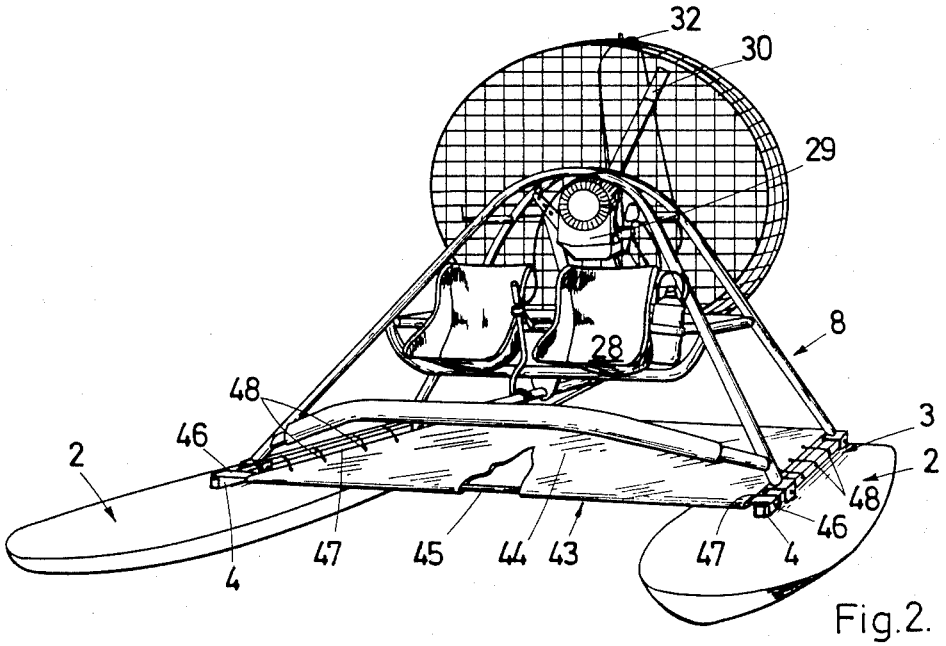
FIGS. 2 and 3 are views similar to FIG. 1 showing variations of the boat as shown in said FIG. 1.

To avoid projecting water on the passengers and mostly on the propeller 30 and engine 29, the boat comprises projecting means 43 which are arranged between said floats 2, above same and which are associated either with the framing 8 or with the frames 3. In the embodiment as shown in FIG. 2, said protecting means 43 are comprised of a sheet 44 stretched over a tube 45 secured in 46 to frame elements 4 and joined thereto along the sheet edges 47, by straps 48. The presence of said sheet 44 has the advantage at high speed, to let the floats 2 lift-up more easily, which is further enhanced by the keels 40.

Said protecting means 43 may also be so shaped as to form a wing the leading edge of which faces to the float front and lies substantially in a plane at right angle to the float lengthwise axes, which further increases the lift-up capacity of said floats.

Figure 3:
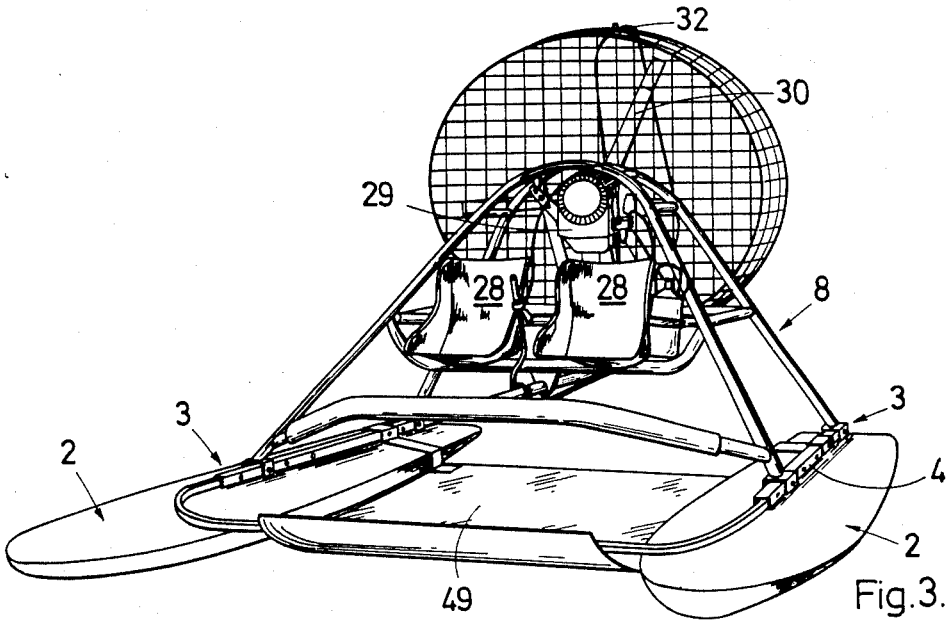

In the boat embodiment as shown in FIG. 3, said boat comprises underneath and in front of the passenger seats 28, a transparent component 49, which may be undistortable, secured to the frames 3 and so arranged as to move on the water surface to smooth same and allow a good view in the water.

It must be understood that the invention is in no way limited to the above embodiments and that many changes may be brought thereto without departing from the invention scope as defined by the appended claims.

For instance, the boat driving means 11 might be comprised of an outboard motor or a turbine which is supported by the framing and hinged thereon to allow steering the boat.

I claim:

1. A boat which comprises at least two sail surf-board floats each having a top surface, a well and a lengthwise axis, a frame cooperating with each said float and comprised of two rigid elements each having a lengthwise axis and mounted on the respective float, with one of said elements disposed on said top surface and the other of said elements disposed in said well of said respective float with a portion thereof engaging the bottom of said respective float and fastening means so arranged through said well to link said elements temporarily together, to press said one element disposed on said top surface against the float and to fix said one element relative thereto in such a way as to have said one element's lengthwise axis and the float's lengthwise axis lie substantially in the same vertical plane, a rigid framing comprising at least four fastening lugs associated in pairs with each said rigid element and so arranged as to retain said elements and thereby the floats substantially in parallel relationship, means supported by the framing and so arranged as to receive at least one passenger, means associated with the framing and so arranged as to drive the boat, and means associated with the framing and so arranged as to steer said boat; said fastening means for said rigid elements for each float being adjustable to allow adjustment for different float thicknesses, each said fastening means comprising a sleeve secured at a right angle to the other of said elements disposed in said respective well and which has uniformly distributed holes along said axis thereof, a rod co-axial with said sleeve, said rod having a free end, said rod being so arranged as to be freely movable in said sleeve and having adjacent the one end thereof a hole extending at a right angle to the axis thereof, a bolt member fitted into two corresponding openings in said sleeve and in said rod hole to fix said rod in a selected position relative to said sleeve, said free end of said rod passing through an opening provided in the one element disposed on said top surface of the respective float and said one element being provided with a hole extending at a right angle to the rod axis, a cam lever, a shaft connected to said cam lever, said shaft being received in said hole of said one element, said cam lever bearing against a portion of said one element to exert a pressure thereon which is transmitted by said rod to the other element to press said elements firmly against said respective float, means being provided on said one element to lock said cam lever in a position where said respective float is fixed relative to said rigid elements 2. Boat as defined in claim 1, in which said rigid elements comprising each said frames, are so arranged as to have at least said one element lying above the float be so shaped as to conform to the shape thereof and extend over at least a substantial length portion of said float to enhance the rigidity thereof.

3. Boat as defined in claim 1, in which the rigid element from each said frames which lies underneath the float, is so shaped as to be sunk for the major part, in the said well.

4. Boat as defined in claim 1, in which the rigid element from each frame the framing is associated with, has uniformly-distributed holes along the lengthwise direction thereof, in such a way that said corresponding fastening lugs from said framing may be moved and secured to said one element to adjust the position of the center of gravity from the boat formed by the framing, the means associated therewith and the passenger, relative to the hydrodynamic buoyancy center.

5. Boat as defined in claim 1, which further comprises protecting means, which are arranged between the floats, above said floats, and are associated with the framing.

6. Boat as defined in claim 5, in which said protecting means are comprised of a sheet stretched between the rigid elements from said frames, which lie above said floats.

7. Boat as defined in claim 5, in which said protecting means are so shaped as to form a wing the leading edge of which faces the float front and lies substantially in a plane at a right angle to the float lengthwise axes.

8. Boat as defined in claim 1, in which each said floats comprises along the edge thereof facing the other float, a keel extending from the float back over a major length portion of said floats, said keel being secured to the corresponding frame and comprising a flexible part which conforms to the float outline and lies below the float lower level.

9. Boat as defined in claim 1, which further comprises underneath and in front of the means for receiving the passenger, a transparent component secured to said frames and so arranged as to move on the water surface to smooth same and allow a good view in the water.

10. A boat which comprises at least two sail surfboard floats each having a top surface, a well and a lengthwise axis, a frame cooperating with each said float and comprised of two rigid elements each having a lengthwise axis and mounted on the respective float, with one of said elements disposed on said top surface and the other of said elements disposed in said well of said respective float with a portion thereof engaging the bottom of said respective float and fastening means so arranged through said well to link said elements temporarily together, to press said one element disposed on said top surface against the float and to fix said one element relaitve thereto in such a way as to have said one element's lengthwise axis and the float's lengthwise axis lie substantially in the same vertical plane, a rigid framing comprising at least four fastening lugs associated in pairs with each said rigid element and so arranged as to retain said elements and thereby the floats substantially in parallel relationship, means supported by the framing and so arranged as to receive at least one passenger, means associated with the framing and so arranged as to drive the boat, and means associated with the framing and so arranged as to steer said boat, said framing being tubular and having substantially the shape of a square-based pyramid having corners, said fastening lugs lying at said corners, said means supported by said framing and arranged so as to receive at least one passenger comprising a passenger seat, said floats having a front and said framing having a side facing said front with said passenger seat being disposed on said side of said framing, said framing having a side opposite said front facing side, said means for driving the boat and for steering said boat being arranged and supported on said opposite side of said framing, said means associated with said framing and so arranged as to drive said boat comprising an engine mounted in a cradle provided on said framing and driving an air-propeller, a protective wire housing being provided enclosing said air-propeller, said wire housing having an axis with said framing including a symmetrical plane with the axis of said wire housing lying in said symmetrical plane, vertically and in parallel relationship with said lengthwise axis of said floats, said means associated with the framing and so arranged as to steer said boat comprising an air keel lying in the air-propeller windstream, said air keel having a swing shift axis which lies substantially in said symmetrical plane, said floats lying at a selected level and said air-keel swing shaft extending downwardly to said selected level of said floats, said swing shaft having a back-piece lying substantially in the same plane as said air-keel and being hinged to said swing shaft nearest said floats so as to be swingable about a substantially horizontally axis against the action of a spring, said back-piece being pivotally mounted on said swing shaft so as to be movable about a generally horizontal axis to enable said back-piece to extend into the water to a depth depending on the water depth and dynamic pressure created as said boat moves through the water.

11. Boat as defined in claim 10, in which control means for the boat driving means and steering means are disposed adjacent the passenger seat.

* * * * *